US006910577B2

(12) United States Patent
O'Sullivan

(10) Patent No.: US 6,910,577 B2
(45) Date of Patent: Jun. 28, 2005

(54) ERGONOMIC TOOL BOX

(76) Inventor: Robert P. O'Sullivan, 1515 Kings Avenue, West Vancouver, British Columbia (CA), V7V 2B3

( * ) Notice: Subject to any disclaimer, the term of this patent is extended or adjusted under 35 U.S.C. 154(b) by 61 days.

(21) Appl. No.: 10/631,827

(22) Filed: Aug. 1, 2003

(65) Prior Publication Data

US 2005/0023165 A1 Feb. 3, 2005

(51) Int. Cl.[7] ..... B65D 85/28
(52) U.S. Cl. ..... 206/373
(58) Field of Search ..... 206/349, 372–379, 206/557, 561, 564; 220/659, 669, 674, 675, 771, 772; 312/902

(56) References Cited

U.S. PATENT DOCUMENTS

| | | | | |
|---|---|---|---|---|
| 1,933,894 | A | | 11/1933 | Clink |
| 2,314,835 | A | * | 3/1943 | Johns et al. ..... 220/772 |
| 2,722,352 | A | | 11/1955 | Dehnel |
| 3,463,353 | A | * | 8/1969 | Peebles ..... 206/514 |
| 3,851,756 | A | | 12/1974 | Brown |
| 3,907,105 | A | * | 9/1975 | Nowak ..... 220/771 |
| 4,125,207 | A | * | 11/1978 | Ernst et al. ..... 220/772 |
| 4,244,469 | A | | 1/1981 | Miner |
| 4,846,346 | A | | 7/1989 | Kime |
| 4,997,090 | A | * | 3/1991 | Lenmark et al. ..... 220/771 |
| 5,117,979 | A | | 6/1992 | Brightbill |
| D329,135 | S | | 9/1992 | Embree |
| 5,310,079 | A | | 5/1994 | Sandy et al. |
| 5,370,263 | A | | 12/1994 | Brown |
| D358,484 | S | | 5/1995 | Cautereels et al. |
| 5,445,425 | A | | 8/1995 | Lyver |
| 5,715,968 | A | * | 2/1998 | Fink et al. ..... 220/669 |
| 5,738,241 | A | | 4/1998 | McEntee |
| 6,039,205 | A | | 3/2000 | Flink |
| 6,053,316 | A | | 4/2000 | Lo |
| 6,062,385 | A | | 5/2000 | Cho |
| 6,070,732 | A | | 6/2000 | Chen |
| 6,213,296 | B1 | | 4/2001 | Streich et al. |
| 6,516,948 | B1 | * | 2/2003 | Caballero ..... 206/373 |
| 6,520,513 | B2 | | 2/2003 | Presley-Mays |
| 6,533,138 | B2 | | 3/2003 | Chwen-Ru |
| 2002/0170843 | A1 | | 11/2002 | Dieter et al. |
| 2002/0180227 | A1 | | 12/2002 | Dedicke II |
| 2003/0000859 | A1 | | 1/2003 | Straface |

FOREIGN PATENT DOCUMENTS

| | | |
|---|---|---|
| CA | 2019399 | 7/1991 |
| EP | 0 015 827 A1 | 9/1980 |
| EP | 0 486 108 A2 | 5/1992 |
| GB | 2 255 898 A | 11/1992 |
| GB | 2 270 066 A | 3/1994 |
| GB | 2 359 542 A | 8/2001 |
| WO | WO 89/05030 | 6/1989 |
| WO | WO 99/43564 | 9/1999 |

* cited by examiner

*Primary Examiner*—Luan K. Bui
(74) *Attorney, Agent, or Firm*—Oyen Wiggs Green & Mutala LLP

(57) ABSTRACT

This invention relates to a novel design of ergonomic tool box. More particularly, this invention relates to a novel construction of ergonomic tool box which has upper and lower handles for ease of carrying, and an indented side which enables the ergonomic tool box to be carried closer to the vertical center of gravity of the carrier, thereby reducing strain on the carrier. An ergonomic tool box comprising: (a) an elongated hollow base with one of the sides of the base being indented inwardly towards the interior of the hollow base; (b) a handle disposed upwardly from the hollow base; and (c) at least one support for the handle extending upwardly between the base and the handle.

20 Claims, 7 Drawing Sheets

ERGONOMIC TOOL BOX

FIELD OF THE INVENTION

This invention relates to a novel design of ergonomic tool box. More particularly, this invention relates to a novel construction of ergonomic tool box which has upper and lower handles for ease of carrying, and an indented side which enables the ergonomic tool box to be carried closer to the vertical center of gravity of the carrier, thereby reducing strain on the carrier.

BACKGROUND

Tool boxes are widely used by tradesmen such as carpenters, mechanics and the like for the purpose of holding and carrying tools of their trade. In the carpenter's trade, this can be handsaws, chisels, glue bottles, screws, nails, staplers and other tools of the carpenter trade.

When a tool box is full of such tools, which are mostly metal, the tool box is heavy and the tradesman can incur back fatigue or injury by lifting and carrying such heavy tool boxes. One difficulty with conventional tool boxes is that because the body of the tradesman has width, the tool box must be carried on one side of the tradesman. This means that the vertical center of gravity of the tool box with its tool contents is positioned laterally of the vertical center of gravity of the tradesman. This exerts a significant lateral bending moment on the spine of the tradesman. This can ultimately lead to back fatigue or injury.

Another problem with conventional tool box designs is that they have only one handle. Usually, the handle is disposed at a low elevation and the trades-man must bend down a good distance in order to grasp the handle of the tool box and lift it. Lifting the tool box to a standing position can exert an uneven force on the back of the tradesman which in turn can lead to back fatigue or injury.

The following patents are relevant to the subject matter of this invention:

U.S. Pat. No. 2,722,352, issued Nov. 1, 1955, Dehnel, discloses a tool box for a truck body of the type having a vertical side panel with an outwardly flared top flange, the box comprising means forming top, end, front and bottom walls integrated to form an open backed enclosure, the top wall being narrower than said end walls and provided with a downwardly inclined flange along its rear edge adapted to engage the marginal portion of the top flange and to be secured thereto, the end walls extending rearwardly beyond the top wall to such extent as to contact the side panel when the downwardly inclined flange is positioned in engagement with the top flange, the front wall being provided with an access opening to the enclosure bounded by said walls and the parts of said truck body engaged thereby, and a door closing said opening.

U.S. Pat. No. 5,738,241, issued Apr. 14, 1998, McEntee, discloses a substantially rectangular multi-purpose box comprising a outwardly extending, convexly-curved front and back walls, and side walls, the front, back and side walls surrounding a main compartment, a front tray which extends outwards from the upper portion of the front wall, and a contoured lid to cover the multipurpose craft box. The main compartment contains a plurality of opposing grooves for receiving a partition so that the main compartment may be subdivided into smaller compartments. A shoulder runs along the inside surfaces of the front and back wails forming a resting surface for supporting a container. The front tray is divided into a plurality of compartments. Opposing slots located in the inner wails of the compartments for receiving dividers allows a user to further subdivide each front tray compartment.

U.S. Pat. No. 6,039,205, issued Mar. 21, 2000, Flink, discloses a stackable shopping basket in which the proximal side wall is inwardly curved in a contour adapted to an adult human user's body. The opposite or distal side wall may also be curved with a contour that is symmetrical with the proximate side wall. The side walls and end walls have an outwardly-turned peripheral top edge forming a lip, the lip being extended downward along at least a portion of the proximal side wall to form a cushion portion. Stand-off fins are provided along the periphery of the basket between the lip and the end walls and side walls other than the cushion portion. A centrally located handle projects from the bottom of the basket and defines a channel through the bottom wall of the basket for nesting identical baskets in a stack. The grip of the handle is oriented along the longitudinal axis of the basket. The grip may have a detachable cover to display advertising.

U.S. Pat. No. 6,053,316, Apr. 25, 2000, Lo, discloses a tool box includes a housing having one or more orifices for receiving tool members. One or more casings are attached to the housing and each has one or more punctures for receiving the tool members. A cap has one end pivotally coupled to the housing and has the other end engaged with the housing and the casings to secure the housing and the casings together. The housing includes a curved bar and the casing includes a curved slot for receiving the bar and for securing the casing to the housing. The cap includes a latch engaged with the housing and the casings.

U.S. Pat. No. 6,533,138 B2, Mar. 18, 2003, Chwen-Ru, discloses a foldable tool kit comprises two abutted elongate first compartments, two abutted second compartments on either side of the first compartment, each second compartment being smaller than the first compartment, and a plurality of hinges each for coupling each of the second compartments to the first compartment or two of the second compartments on the same side. The stored tools are protected from being lost due to the provisions of engaged positioning pegs and holes on the second compartments as well as prevented from mixing due to the provision of covers on the second compartments while carrying.

U.S. patent application Publication No. US2002/0170843 A1, Nov. 21, 2002, Dieter et al., discloses a receptacle for storing and holding tools such as utensils and knives is selectively between a flat position in which tools held within slots in the receptacle are held in place and cannot be removed, and an open, curved position in which the receptacle forms a stable stand. In the open position the handles of the tools are exposed and may be readily removed for use and reinserted into holding slots when not in use.

The following patents are also of potential interest:

| Patent or Publication No. | Issue/Publication Date | Inventor |
|---|---|---|
| U.S. Pat. No. 5,310,079 | May 10, 1994 | Sandy et al. |
| U.S. Pat. No. 2003/0000859 A1 | Jan. 2, 2003 | Straface |
| WO 99/43564 | Sep. 2, 1999 | Lindberg |
| U.S. Pat. No. 4,846,346 | Jul. 11, 1989 | Kime |
| U.S. Pat. No. | Jun. 2, 1992 | Brightbill |

-continued

| Patent or Publication No. | Issue/Publication Date | Inventor |
|---|---|---|
| 5,117,979 | | |
| U.S. Pat. No. 5,370,263 | Dec. 6, 1994 | Brown |
| U.S. Pat. No. 5,445,425 | Aug. 29, 1995 | Lyver |
| EP 0015827 A1 | Sep. 17, 1980 | Lacoste |
| GB 2255898 | Nov. 25, 1992 | Green |
| GB 2359542 A | Aug. 29, 2001 | Huang |
| WO 89/05030 | Jun. 1, 1989 | Suthanthiran |
| U.S. Pat. No. 1,933,894 | Nov. 7, 1933 | Clink |
| U.S. Pat. No. 4,244,469 | Jan. 13, 1981 | Miner |
| U.S. Pat. No. 6,070,732 | Jun. 6, 2000 | Chen |
| U.S. Pat. No. 6,213,296 B1 | Apr. 10, 2001 | Streich et al. |
| U.S. Pat. No. 6,520,513 B2 | Feb. 18, 2003 | Presley-Mays |
| U.S. Pat. No. 3,851,756 | Dec. 3, 1974 | Brown |
| U.S. Pat. No. 6,062,385 | May 16, 2000 | Cho |
| U.S. Pat. No. 2002/0180227 A1 | Dec. 5, 2002 | Dedicke II |
| GB 2270066 A | Mar. 2, 1994 | Bates |
| CA 2,019,399 | Jul. 26, 1991 | Hanna et al. |
| EP 0486108 A2 | May 20, 1992 | Benraad |
| US Des. 358,484 | May 23, 1995 | Cautereels et al. |
| US Des. 329,135 | Sep. 8, 1992 | Embree |

SUMMARY OF INVENTION

The invention is directed to an ergonomic tool box comprising: (a) an elongated hollow base with one of the sides of the base being indented inwardly towards the interior of the hollow base; (b) a handle disposed upwardly from the hollow base; and (c) at least one support for the handle extending upwardly between the base and the handle.

The base of the tool box can have longitudinal and lateral sides and one of the longitudinal sides can be inwardly indented. The indentation can be ¼ to ½ of the width of the hollow base. The handle can be parallel to the base and can extend in a longitudinal direction. The tool box can include tool receptacle holes disposed spatially in the interior of the hollow base.

The tool box can include a second handle and at least one handle support disposed at an elevation lower than the first or upper handle. The height of the second handle can be between ¼ and ½ of the height of the upper handle. The first upper handle can be aligned with the longitudinal centre-line of the box and the second lower handle can be offset laterally from the first handle.

The inwardly indented side of the tool box can be curved and can have a radius of curvature of approximately 3 feet.

The tool box can include two supports for the handle, said supports having an "A" configuration with hollow interior.

The tool receptacles can be deployed spatially in front and rear ledges which can extend longitudinally on the interior sides of the hollow base. The rear tool receptacle ledge can be spaced from the rear wall of the hollow base.

The tool box can include a flexible rod disposed longitudinally within the interior of the hollow base. The height of the base can be approximately ⅓ the height of the first upper handle. The width of the base can be between 8 and 12 inches. The length of the box can be approximately 3 feet.

BRIEF DESCRIPTION OF DRAWINGS

In drawings which illustrate specific embodiments of the invention, but which should not be construed as restricting the spirit or scope of the invention in any way.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
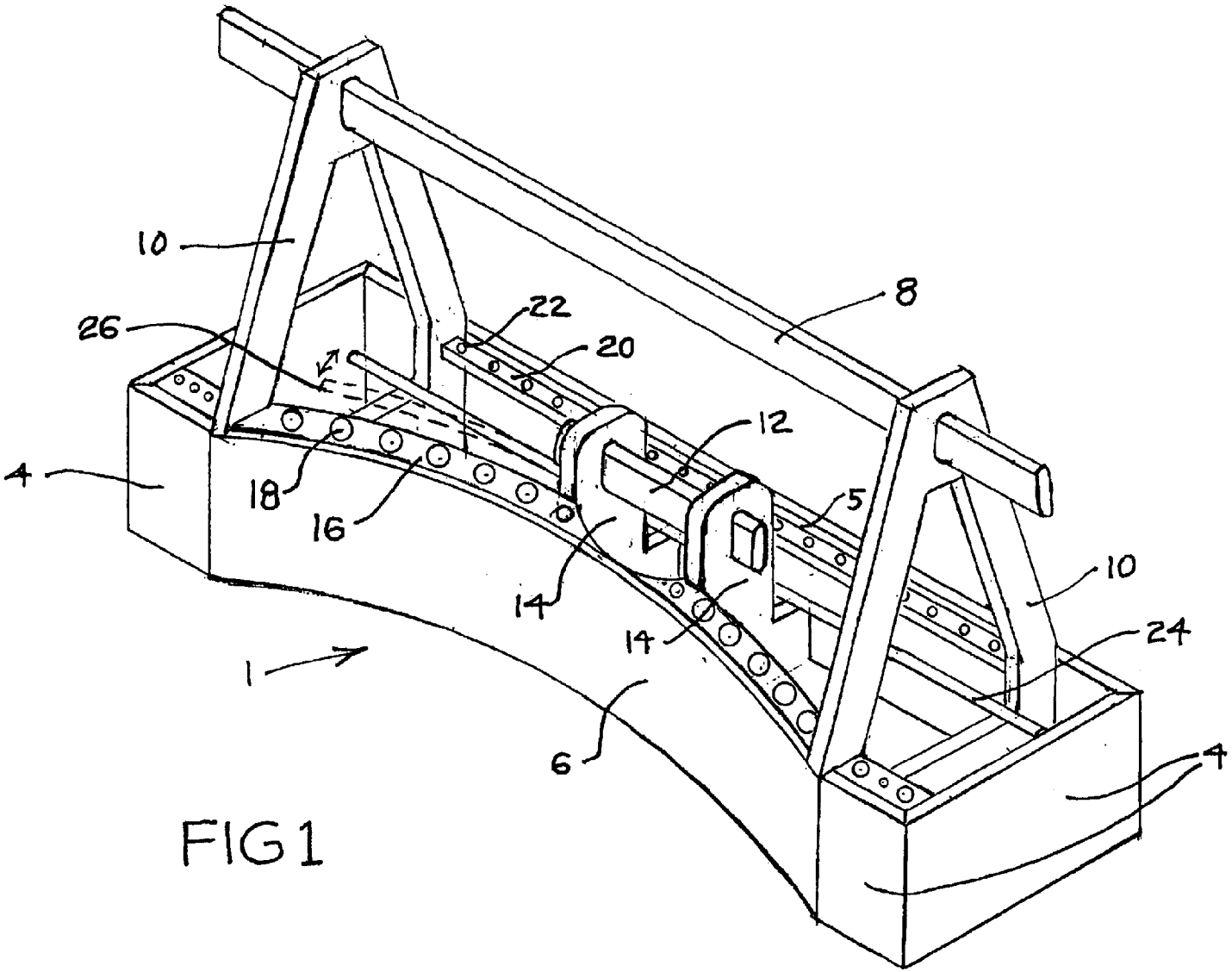
FIG. 1 illustrates an isometric view of the ergonomic tool box.

The ergonomic tool box according to the invention will now be discussed in association with the accompanying drawings. As shown in the drawings, FIG. 1 illustrates an isometric view of the ergonomic tool box 1. The ergonomic tool box 1 is constructed with an elongated base 4 which has on one side a curved indentation 6. Above the base 4, there is disposed a longitudinal horizontally extending upper handle 8, which is supported by and connected to the base 4 by a pair of A-frame vertical handle supports 10, 10.

The ergonomic tool box 1 also includes a lower horizontal handle 12, which is supported by a pair of lower handle supports 14, 14. The indented side 6 has along its upper interior edge a curved front tool receptacle ledge 16 which has incorporated therein a plurality of front tool receptacle holes 18. These can be used for carrying various chisels and other woodworking tools that are typically used by a carpenter tradesman such as a custom cabinet maker.

The ergonomic tool box base 4 also has disposed along its upper rear interior side, between the two vertical handle supports 10, 10, a longitudinally horizontally extending rear tool receptacle edge 20. This rear tool receptacle edge 20 has disposed therein a plurality of rear tool receptacle holes 22. It should be noted that the rear tool receptacle edge 20 is spaced a short distance from the rear edge of the rear base to provide a space 5. This space 5 can be used for inserting the blade of a handsaw or some other thin instrument for storage.

The interior of the base 4 of the ergonomic tool box 1 includes a flexible horizontal pinch bar 24, which can be bent as indicated by dotted lines 26. This pinch bar 24, by being flexible, can be used to hold various cans and bottles in the interior of the base 4, such as glue bottles, varnish cans and the like.

An important feature of the ergonomic tool box 1 is that it has a curved indented side 6. The dimensions of the object should be consistent with the size of the person who will be using the object. Assuming, for instance, that the height of the tradesman is in the neighborhood of 6 ft., then the diameter of curvature of the indented side 6 should be about 6 ft. The curvature of indented side 6 is thus of a dimension which enables the legs of the tradesman carrying the tool box to move easily during walking and not impinge against the tool box 1. Another important feature of the indented curved side 6 is that it enables the vertical center of gravity axis of the tool box 2, which can be quite heavy when filled with heavy tools and the like, to be located laterally closer to the vertical center of gravity axis of the tradesman carrying the tool box 1. This design of tool box 1 therefore reduces the size of the lateral force that is exerted on the back (spine) of the tradesman and thereby reduces or minimizes back fatigue or back injury.

The length of the box 1 is not related to the radius of curvature of the indented side 6. However, the length of the tool box 1 is coincidentally preferably about 3 feet, which is the same as the radius of curvature of the indentation 6.

Figure 2:
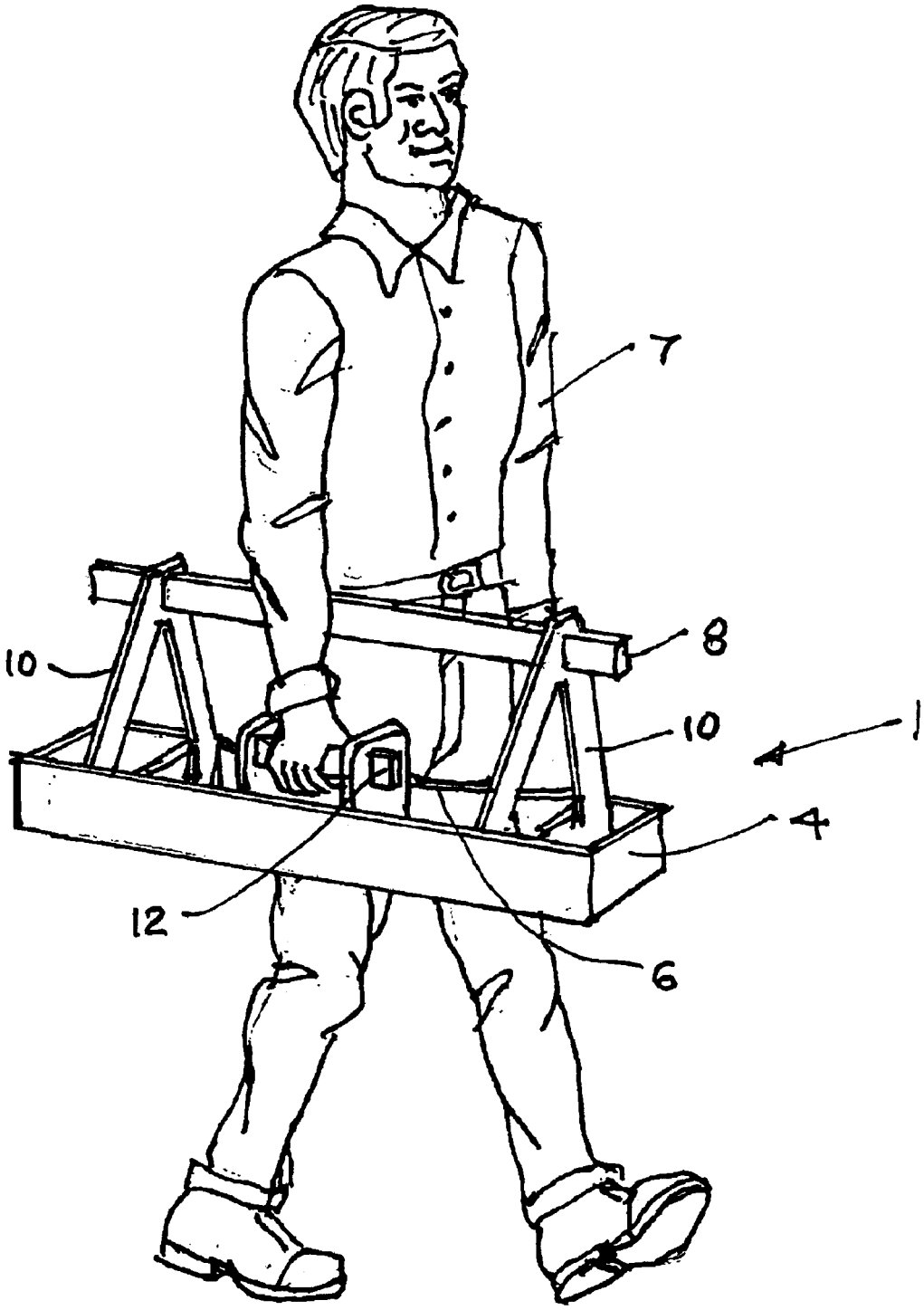
FIG. 2 illustrates an isometric view of a tradesman carrying the tool box by the lower handle.

FIG. 2 illustrates an isometric view of a tradesman 7 carrying the ergonomic tool box 1 comprising base 4, upper handle 8, supported by the pair of A-frame handle supports 10, 10 and the lower handle 12. As seen in FIG. 2, the tradesman 7 is carrying the tool box 1 by the lower handle 12. At the same time, he is holding the upper handle 8 on the inside of the forearm of his right arm. This combination of the lower handle 12 held by the hand and the upper handle 8 held by the forearm enables the tradesman 7 to maintain full control over the ergonomic tool box 2. Another advantage of the upper handle 8 and lower handle 12 design is that when the tool box 1 is resting on the ground, the tradesman 7 need bend over only a limited extent to lift the tool box 1 by the upper handle 8. Then when he has raised the tool box 1 to a partial position, he can then transfer his grip from the upper handle 8 to the lower handle 12, and thereby raise the tool box 1 to a comfortable carrying position as shown in FIG. 2. The ergonomic tool box 1, when carried by the lower handle 12, rides at a higher elevation relative to the tradesman 7, and reduces or minimizes the lateral force exerted on the back of the tradesman 7.

If the person carrying the box 1 is 6 ft. in height, the upper handle 8 should preferably be 18 in. of his or her height above the bottom of the base 4 to thereby provide a height which is convenient to assist the tradesman to lift the box 1 by the handle 8. The height of the lower handle 12 should be preferably ⅔ or 9 to 12 inches below the elevation of the upper handle 8. The height of the base 4 should be about 6 inches.

Figure 3:
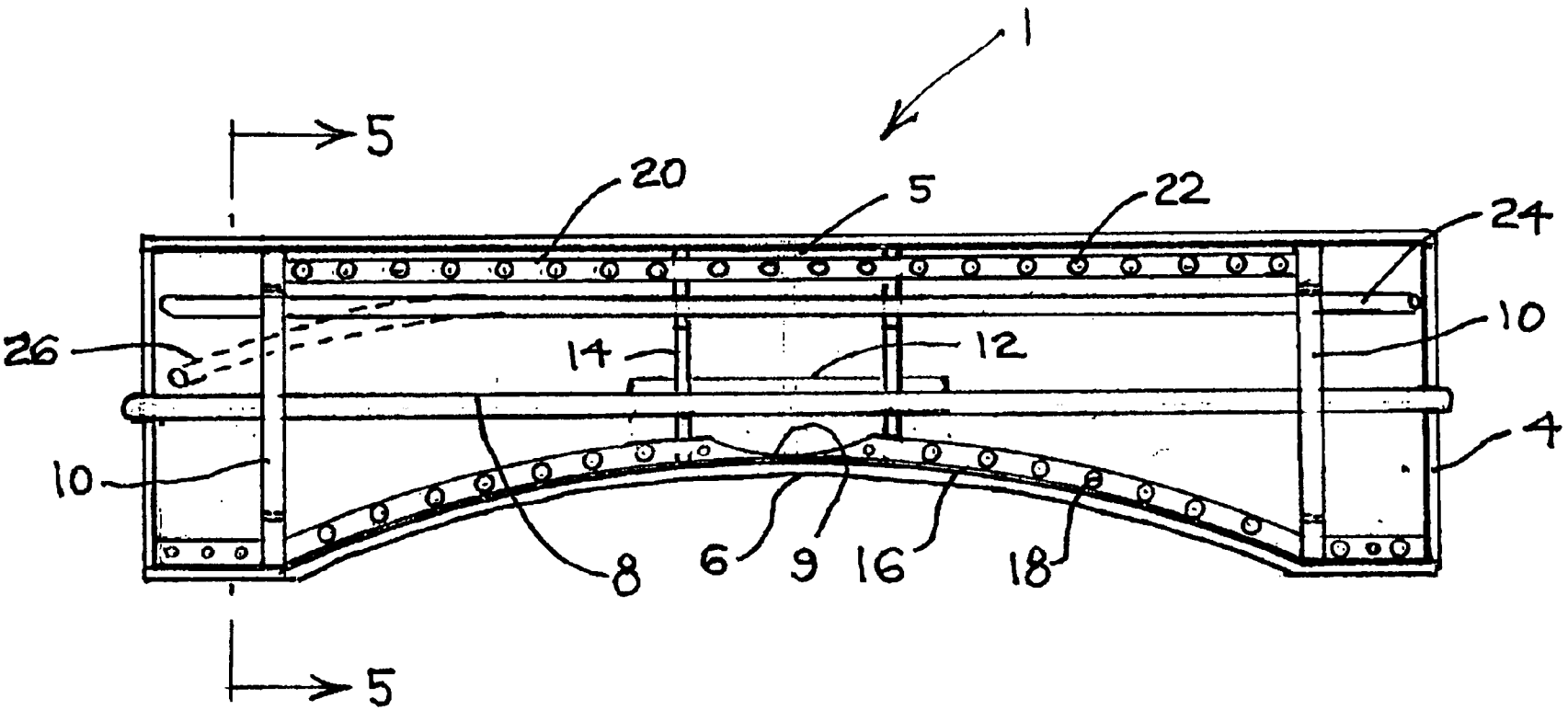
FIG. 3 illustrates a plan view of the ergonomic tool box.

FIG. 3 illustrates a plan view of the ergonomic tool box 1. The base 4 of the tool box 1 is elongated and typically measures 3 ft. in length. The width of the box is typically 9 to 10 inches, roughly ½ of the height of the upper handle 8. The curved indented side 6 is readily visible in FIG. 3. If the length of the tool box 1 is 3 ft., then the radius of curvature of the curved indented side 6 is preferably about 3 ft. Ideally, the indentation extends ¼ to ½ way into the width of the tool box 1. If the indentation 6 is less, then its ergonomic value to the tradesman is diminished. If it is more than ½, then the interior capacity of the box 1 for holding tools is reduced unnecessarily. The pair of A-frame handle supports 10, 10 carries the longitudinally extending upper handle 8 and connect to the base 4. The upper handle 8 extends along the longitudinal centre of the tool box 1. The lower handle 12, as is evident in FIG. 3, is offset laterally relative to the upper handle 8 in a direction away from the indented side 6. This offset position of the lower handle 12 assists in permitting the tradesman 7 to carry the tool box by the lower handle 12, and hold the upper handle 8 inside his forearm as illustrated previously in FIG. 2. FIG. 3 also illustrates the front tool receptacle ledge 16 which is curved to conform with the radius of curvature of the curved indented side 6. Front tool receptacle holes 18 are spatially formed along the length of the curved front tool receptacle ledge 16. A curved indentation 9 adjacent lower handle 12 is also illustrated in FIG. 3. This indentation 9 provides space for the fingers of the hand of the tradesman 7 when carrying the tool box 1 by the lower handle 12 as shown in FIG. 2.

FIG. 3 further illustrates rear tool receptacle edge 20 and its spatially arranged series of rear tool receptacle holes 22 extending between the respective A-frame handle supports 10, 10. It should be noted that the rear tool receptacle ledge 20 is spaced from the rear wall of the tool box 1 as designated by reference numeral 5. This space 5 can be used to store the blade of a handsaw, or some other thin article such as a square, between the rear tool receptacle ledge 20 and the rear side of the box 1.

Lastly, FIG. 3 illustrates a longitudinally extending flexible pinch bar or rod 24, which can be flexed at either end, as indicated, for example, by dotted lines 26. This flex bar 24 assists in holding in the tool box 2 containers such as glue bottles, and the like. This bar 24 keeps them from tipping over. As indicated in FIG. 3, it will be noted that the upper handle 8 at its two ends extends slightly beyond the longitudinal ends of the tool box 4. These slightly protruding ends act as bumpers and protect the ends of the tool box 2 from being hit against objects when the tool box 1 is placed on the ground or floor at the location where the tradesman is working.

Figure 4:
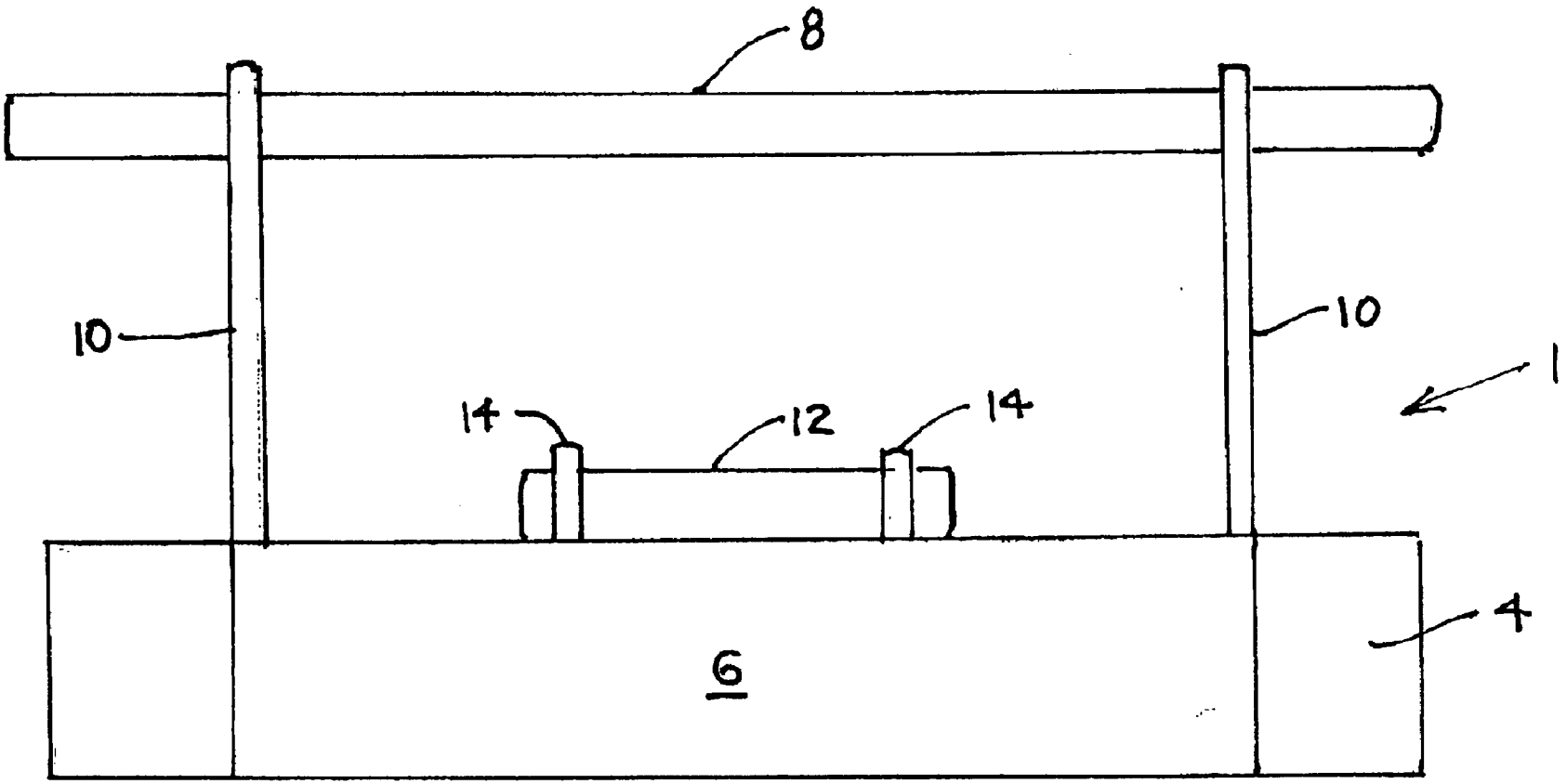
FIG. 4 illustrates a front elevation view of the ergonomic tool box.

FIG. 4 illustrates a front elevation view of the tool box 1 and in particular illustrates the relative heights of the base 4, with curved indented side 6, the lower handle 12 with its respective lower handle supports 14, 14 and the upper handle 8 with its respective A-frame handle supports 10, 10. As mentioned previously, the tool box 1 is typically 3 ft. in length and the base 4 is typically six inches in height. The upper handle 8 is typically 18 in. above the bottom of the base 4. These dimensions are convenient for a tradesman 7 who is 6 ft. in height, but it is appropriate for a height between 5'8" and 6'4". The 6 in. height of the base 4 is convenient for accommodating most carpentry tools. The 18 in. height of the upper handle 8, above the bottom of base 4, is sufficiently high that a tradesman 7 does not have to stoop significantly when reaching down to grasp the upper handle 8. Once the tradesman 7 has grabbed the tool box 1 by the upper handle 8, he can then, if he chooses, transfer his hand to the lower handle 12 in order to carry the tool box 1 more comfortably at a higher elevation as shown in FIG. 2. The height of the lower handle 12 above the bottom of the base 4 is typically 6 to 9 inches.

Figure 5:
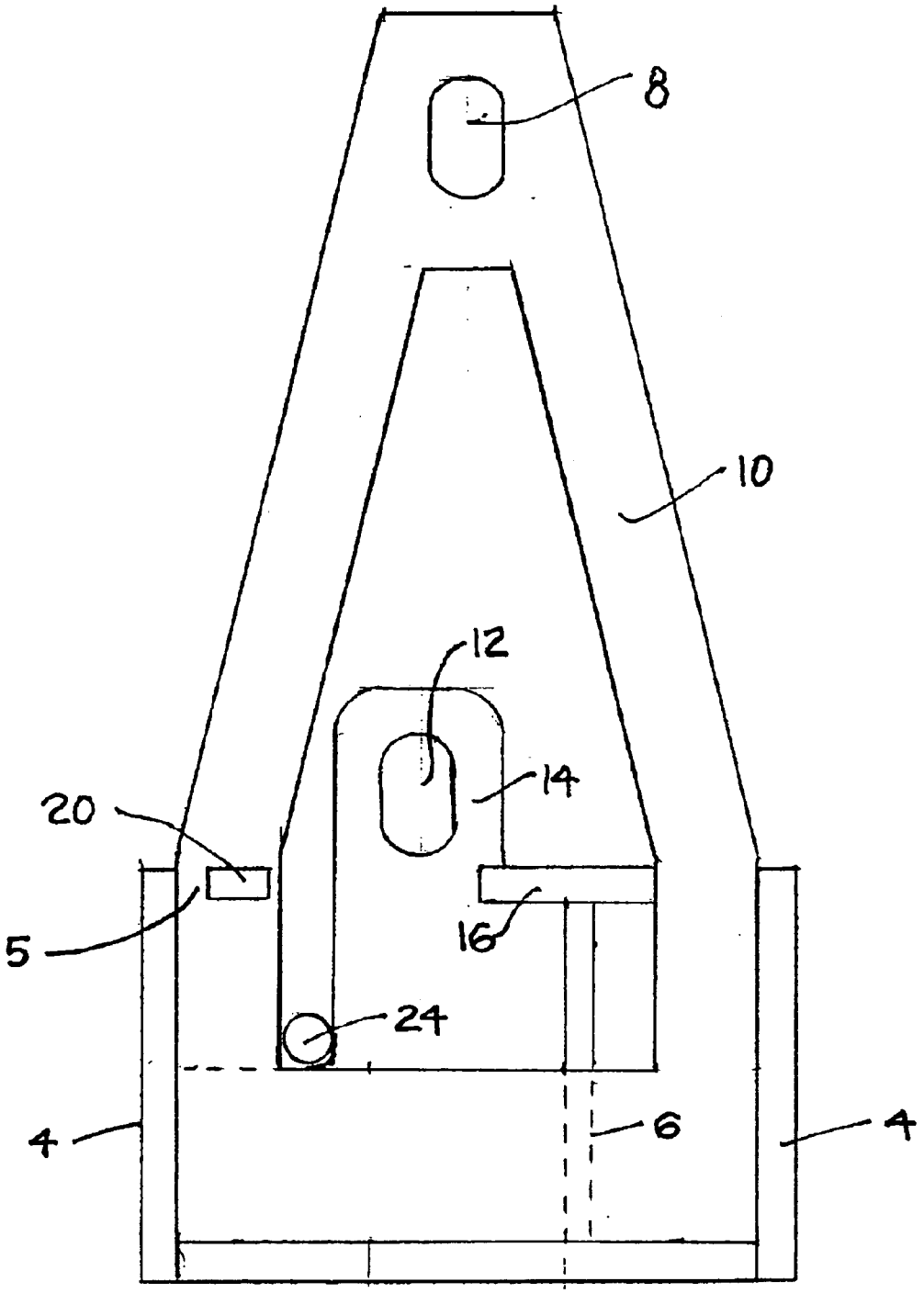
FIG. 5 illustrates a section view taken along section lines 5—5 of FIG. 3.

FIG. 5 illustrates a section view taken along section line 5—5 of FIG. 3. FIG. 5 in particular illustrates the respective positions and configurations of the hollow base 4, the curved indented side 6, shown partially in dotted lines, the front tool receptacle ledge 16 and the rear tool receptacle ledge 20 which are shown on opposite sides of the lower handle 12 and its lower handle support 14. FIG. 5 also illustrates the manner in which the pair of A-frame handle supports 10 fit within the interior of the base 4. Flexible pinch rod 24 is also illustrated and, as can be seen, fits between the lower portion of the rear side of lower handle support 14, and the lower portion of the A-frame handle support 10. As mentioned previously, the pinch rod 24 can be flexed to accommodate containers of various types being placed in the interior of the base 4. FIG. 5 is also useful for demonstrating how lower handle 12 is laterally offset from the centre line of upper handle 8. This offset arrangement makes it more convenient for the tradesman 7 to grip the lower handle 12 and hold the upper handle 8 on the inside of his forearm, while keeping his arm straight, thereby minimizing fatigue.

Figure 6:
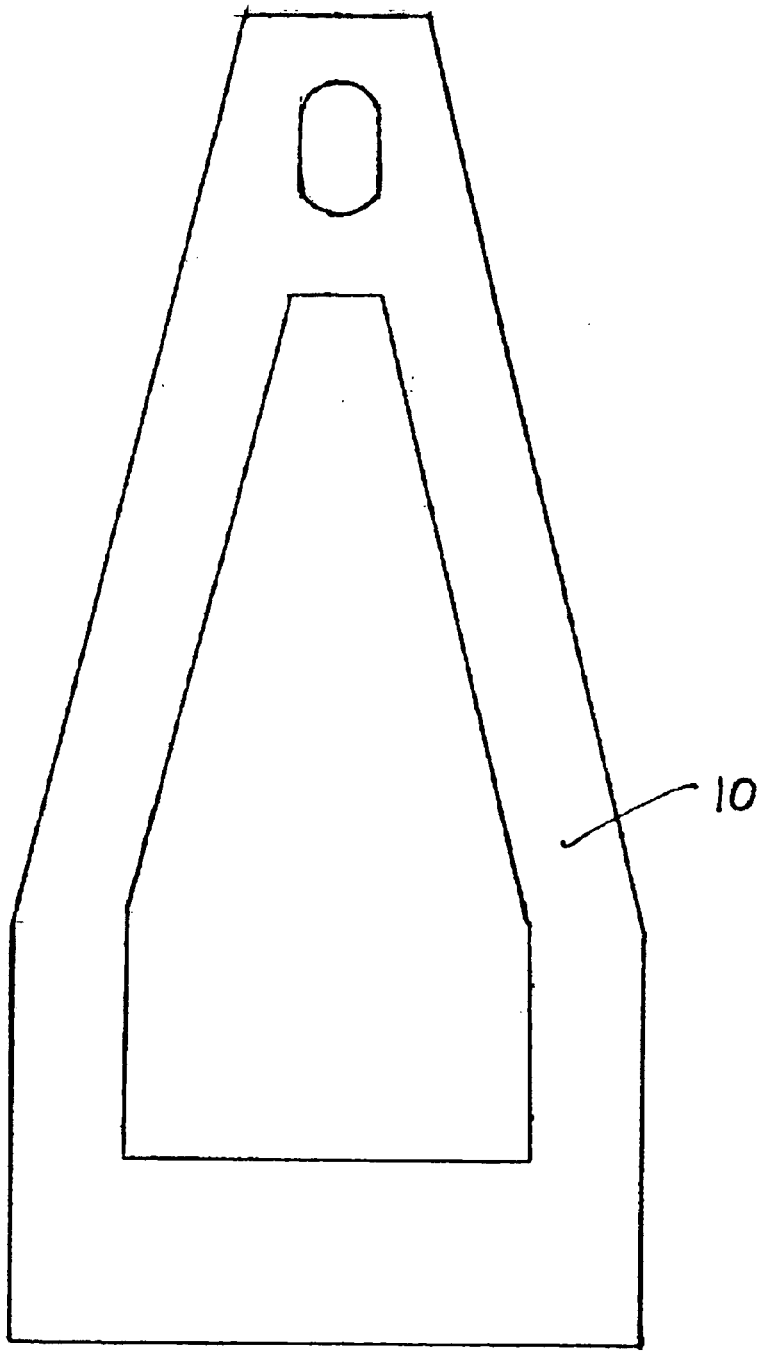
FIG. 6 illustrates an end view of an A-frame handle support for the ergonomic tool box.
Figure 7:
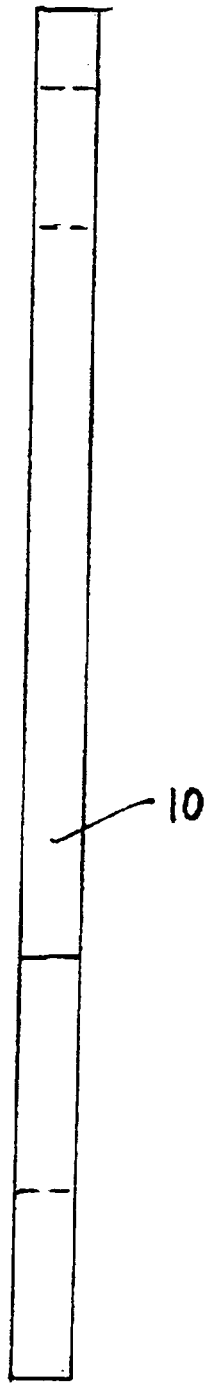
FIG. 7 illustrates an end view of the A-frame handle support.

FIG. 6 illustrates a side view of the A-frame upper handle support 10 with its hollowed interior and the upper opening for receiving upper handle 8 (not shown in FIG. 6). FIG. 7 illustrates a front view of A-frame upper handle support 10, as also illustrated previously in FIG. 6.

Figure 8:
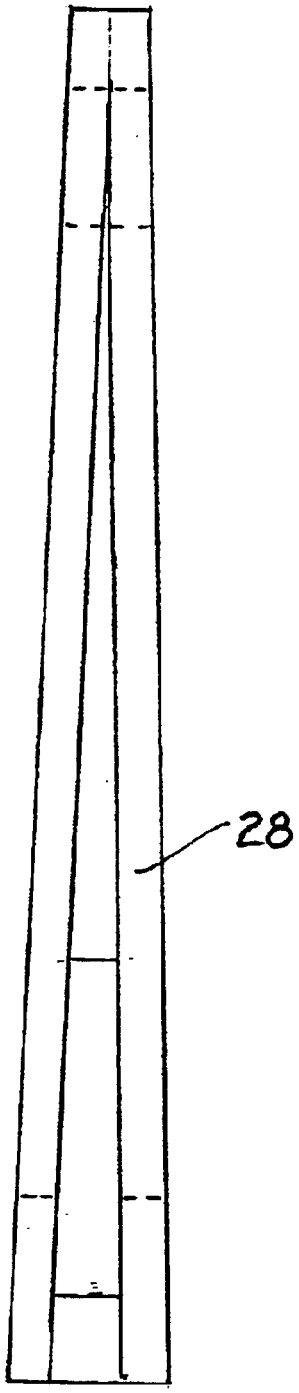
FIG. 8 illustrates an end view of an alternative embodiment of the A-frame handle support, with double supports.

FIG. 8 illustrates an end view of an alternative embodiment of the A-frame handle support, with double supports. The alternative embodiment of A-frame handle support 28, as illustrated in FIG. 8, can be used in situations where a stronger A-frame handle support is required. As can be seen, the double A-frame handle support 28 has two legs for additional strength. In other respects, however, the double A-frame handle support 28 is of similar design to the one illustrated in FIGS. 6 and 7 and has the same end appearance as shown in FIG. 6.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An ergonomic tool box comprising:

(a) an elongated hollow base constructed of two elongated vertical sides, two vertical ends connecting the respective ends of the two vertical sides, and a bottom, the top of the hollow base being open, one of the elongated vertical sides of the base being indented inwardly towards the interior formed by the two vertical sides and the two vertical ends;

(b) a first handle disposed upwardly from the hollow base at a first elevation;

(c) at least one support for the first handle extending upwardly between the two elongated vertical sides and the handle;

(d) a second handle disposed upwardly from the hollow base at an elevation lower than the elevation of the first handle, and laterally offset from the first handle; and (e) at least one support for the second handle extending upwardly from the interior of the hollow base.

2. A tool box as claimed in claim 1 wherein one of the elongated vertical sides is inwardly indented in a central area of the elongated verticle side.

3. A tool box as claimed in claim 1 wherein the indentation is ¼ to ½ of the width of the hollow base.

4. A tool box as claimed in claim 2 wherein the first handle is parallel to the base and extends in a longitudinal direction.

5. A tool box as claimed in claim 4 wherein the first handle is about 18 inches above the bottom of the base.

6. A tool box as claimed in claim 2 including tool receptacle holes disposed spatially in the interior of the hollow base.

7. A tool box as claimed in claim 2 wherein the length of the second handle is shorter than the length of the first handle.

8. A tool box as claimed in claim 7 wherein the height of the second handle is between ¼ and ½ of the height of the first handle.

9. A tool box as claimed in claim 7 wherein the first handle is aligned with the elongated vertical centre-line of the box and the second handle is offset laterally from the centre-line in a direction away from the indented longitudinal side.

10. A tool box as claimed in claim 9 wherein there are spaces between the second offset handle and the adjacent lateral sides.

11. A tool box as claimed in claim 1 wherein the inwardly indented elongated side has a radius of curvature of approximately 3 feet.

12. A tool box as claimed in claim 1 wherein the two supports for the first handle, have an "A" configuration with a hollow interior, the bases of the two "A's" connecting respectively to the two elongated vertical sides at interior locations away from the two vertical ends.

13. A tool box as claimed in claim 6 wherein the tool receptacle holes are deployed spatially in front and rear ledges which extend longitudinally along the interior elongated sides.

14. A tool box as claimed in claim 13 wherein the rear tool receptacle ledge is spaced from the rear elongated side of the hollow base.

15. A tool box as claimed in claim 2 including a flexible rod disposed longitudinally within the interior of the hollow base for holding tools in the box.

16. A tool box as claimed in claim 7 wherein the height of the base is approximately ⅓ the elevation of the first handle.

17. A tool box as claimed in claim 3 wherein the width of the base of the tool box is between 8 and 12 inches.

18. A tool box as claimed in claim 17 wherein the length of the box is approximately 3 feet.

19. An ergonomic tool box comprising:

(a) an elongated hollow base constructed of two elongated vertical sides, two vertical ends connecting the respective ends of the two vertical sides, and a bottom, the top of the hollow base being open, one of the elongated vertical sides of the base being indented inwardly towards the interior formed by the two vertical sides and the two vertical ends, the radius of curvature of the indented longitudinal side being approximately three feet and extending approximately one-third into the interior of the box;

(b) a first handle disposed upwardly from the hollow base at a first elevation;

(c) at least two supports for the first handle disposed spatially from each other and extending upwardly between the two elongated vertical sides and the first handle;

(d) a second handle disposed upwardly from the hollow base at an elevation lower than the elevation of the first handle, and laterally offset from the first handle in a direction away from the indented elongated vertical side; and (e) at least one support for the second handle extending upwardly from the interior of the hollow base.

20. A tool box as claimed in claim 19 wherein the first handle is about 18 inches above the bottom of the base and the second handle is about 6 inches above the bottom of the base.

* * * * *